US010344956B2

(12) United States Patent
Hess

(10) Patent No.: US 10,344,956 B2
(45) Date of Patent: Jul. 9, 2019

(54) MAGNETIC CHRISTMAS LIGHT ASSEMBLY

(71) Applicant: Phillip Hess, Wynne, AR (US)

(72) Inventor: Phillip Hess, Wynne, AR (US)

( * ) Notice: Subject to any disclaimer, the term of this patent is extended or adjusted under 35 U.S.C. 154(b) by 0 days.

(21) Appl. No.: 15/704,723

(22) Filed: Sep. 14, 2017

(65) Prior Publication Data

US 2019/0078764 A1 Mar. 14, 2019

(51) Int. Cl.
*F21S 4/10* (2016.01)
*F21V 21/096* (2006.01)
*F21W 121/00* (2006.01)

(52) U.S. Cl.
CPC ..... *F21V 21/096* (2013.01); *F21S 4/10* (2016.01); *F21W 2121/00* (2013.01)

(58) Field of Classification Search
CPC ..... F21V 21/096; F21S 4/10; F21W 2121/00
See application file for complete search history.

(56) References Cited

U.S. PATENT DOCUMENTS 5,803,577 A 9/1998 Stratton
6,457,842 B1 * 10/2002 Ingrassia ..... F21V 23/04 200/52 R
7,367,697 B2 5/2008 George
8,128,264 B2 * 3/2012 Genenbacher ..... F21V 19/0005 362/249.01
8,308,323 B2 * 11/2012 Holland ..... F21S 4/10 362/391
D671,826 S 12/2012 Adams, IV et al.
8,490,936 B2 7/2013 Rinck
8,491,168 B2 7/2013 Cooper
8,641,228 B1 2/2014 Drake et al.
2006/0279958 A1 * 12/2006 Cline ..... F21V 21/096 362/398
2009/0185370 A1 * 7/2009 Moore ..... F21V 21/088 362/219

FOREIGN PATENT DOCUMENTS

WO WO2011156628 12/2011

* cited by examiner

*Primary Examiner* — Mary Ellen Bowman

(57) ABSTRACT

A magnetic Christmas light assembly for hanging Christmas lights on a metal roof includes a conductor that may be electrically coupled to a power source. A plurality of light emitters is provided and each of the light emitters is electrically coupled to the conductor. A plurality of retainers is provided and each of the retainers is coupled to the conductor. Each of the retainers magnetically engages a support surface thereby facilitating the conductor to be removably retained on the support surface.

4 Claims, 5 Drawing Sheets

MAGNETIC CHRISTMAS LIGHT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to Christmas light devices and more particularly pertains to a new Christmas light device for hanging Christmas lights on a metal roof.

BRIEF SUMMARY OF THE INVENTION

An embodiment of the disclosure meets the needs presented above by generally comprising a conductor that may be electrically coupled to a power source. A plurality of light emitters is provided and each of the light emitters is electrically coupled to the conductor. A plurality of retainers is provided and each of the retainers is coupled to the conductor. Each of the retainers magnetically engages a support surface thereby facilitating the conductor to be removably retained on the support surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
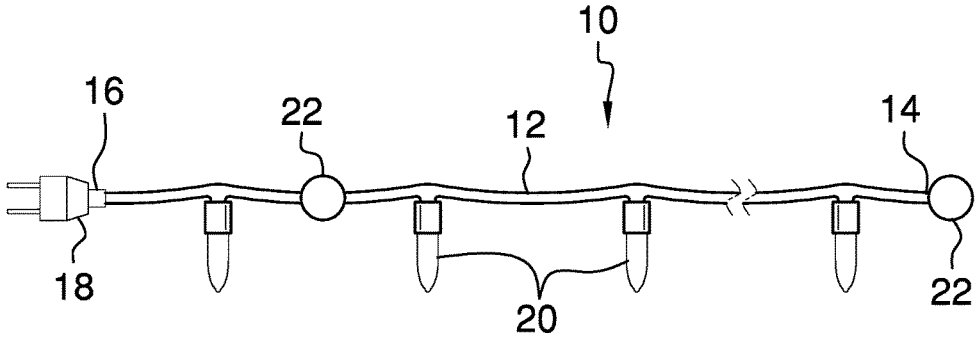
FIG. 1 is a front view of a magnetic Christmas light assembly according to an embodiment of the disclosure.
Figure 2:
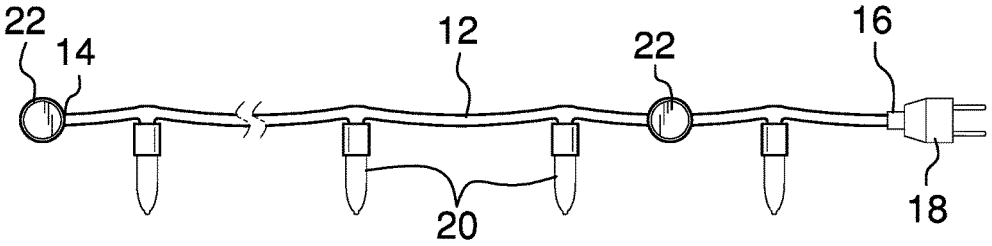
FIG. 2 is a back view of an embodiment of the disclosure.
Figure 3:
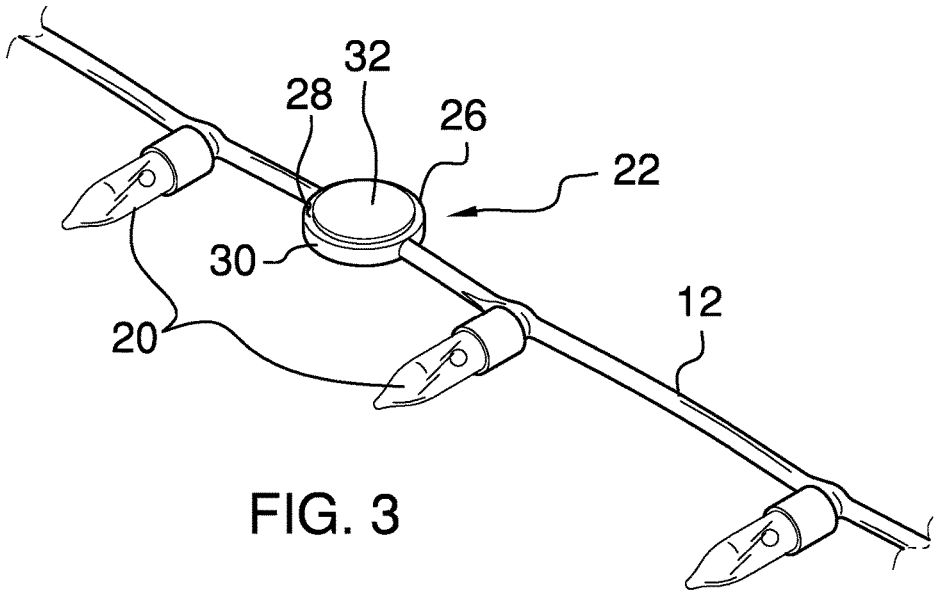
FIG. 3 is a perspective view of an embodiment of the disclosure.
Figure 4:
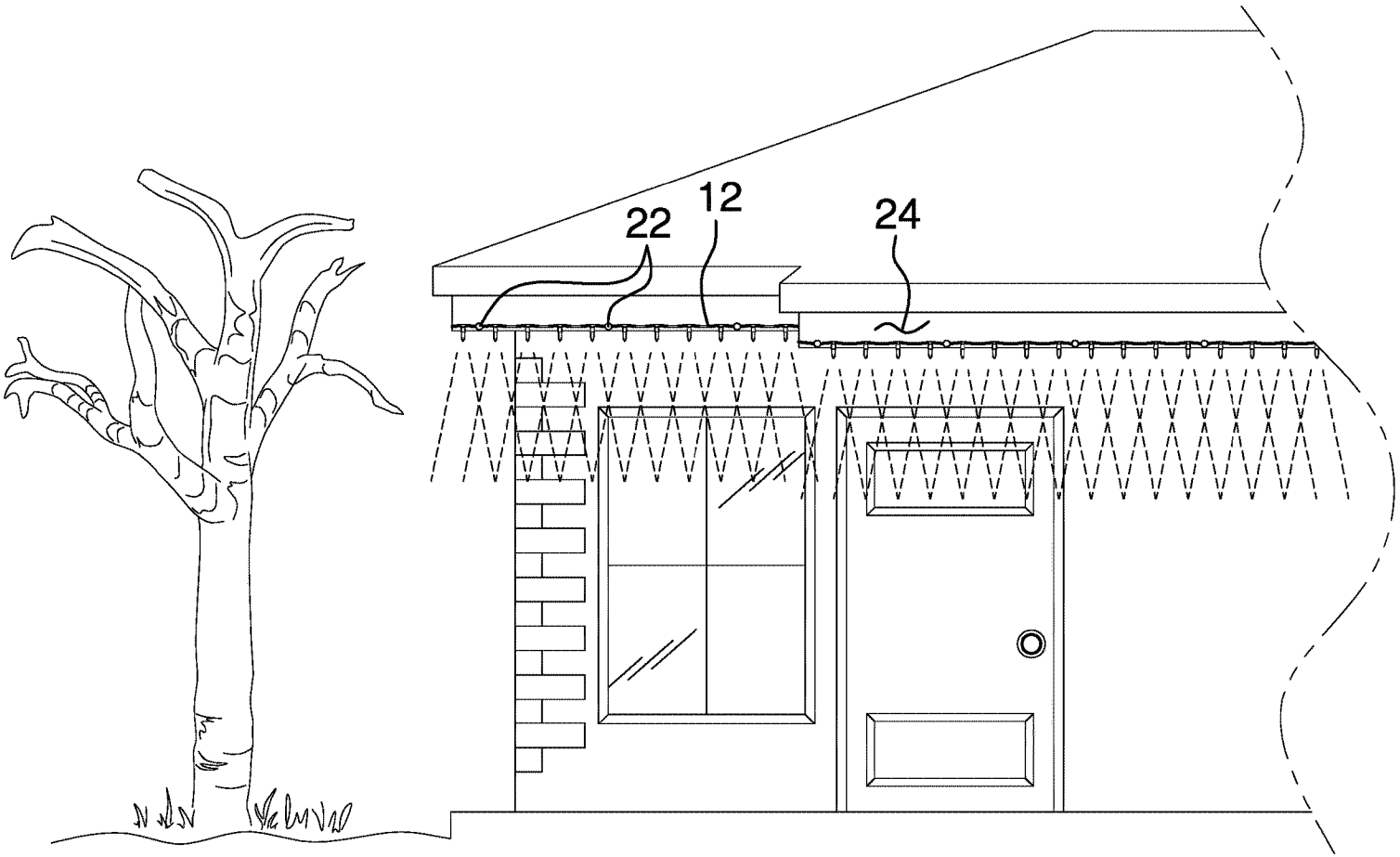
FIG. 4 is a perspective in-use view of an embodiment of the disclosure.

With reference now to the drawings, and in particular to FIGS. 1 through 6 thereof, a new Christmas light device embodying the principles and concepts of an embodiment of the disclosure and generally designated by the reference numeral 10 will be described.

As best illustrated in FIGS. 1 through 6, the magnetic Christmas light assembly 10 generally comprises a conductor 12 that is selectively and electrically coupled to a power source. The power source may be a female electrical outlet on a building. The building may be a house with a metallic roof or any other building with a metallic roof. The conductor 12 has a first end 14 and a second end 16 and the conductor 12 may be a string of Christmas lights of any conventional design and length.

A plug 18 is electrically coupled to the conductor 12 and the plug 18 is selectively and electrically coupled to the power source. The plug 18 is positioned on the second end 16 the conductor 12. A plurality of light emitters 20 is provided and each of the light emitters 20 is electrically coupled to the conductor 12 to selectively emit light. The light emitters 20 are spaced apart from each other and are distributed along the conductor 12. Each of the light emitters 20 may be Christmas lights of any conventional design.

A plurality of retainers 22 is provided and each of the retainers 22 is coupled to the conductor 12 to magnetically engage a support surface 24. In this way the conductor 12 is removably retained on the support surface 24 without penetrating the support surface 24. The support surface 24 may be the metallic roof on the building. The retainers 22 are spaced apart from each other and are distributed between the first end 14 and the second end 16.

Each of the retainers 22 comprises a disk 26 that has a first surface 28 and a peripheral edge 30. The conductor 12 extends through the peripheral edge 30 such that the disk 26 is coupled to the conductor 12. A magnet 32 is coupled to the first surface 28 of the disk 26 and the magnet 32 magnetically engages the support surface 24. In this way the conductor 12 and the light emitters 20 are removably retained on the metallic roof of the building without the use of penetrating fasteners, adhesives and any other non-magnetic means of attaching Christmas lights.

Figure 5:
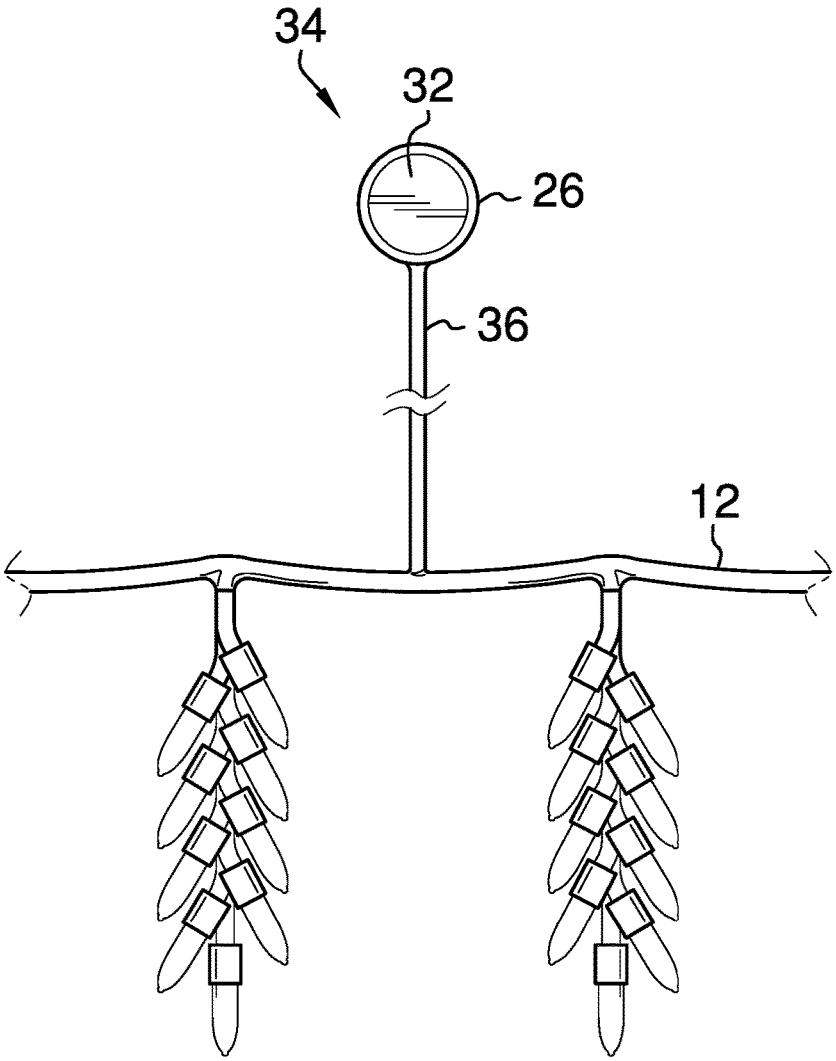
FIG. 5 is a front view of an alternative embodiment of the disclosure.
Figure 6:
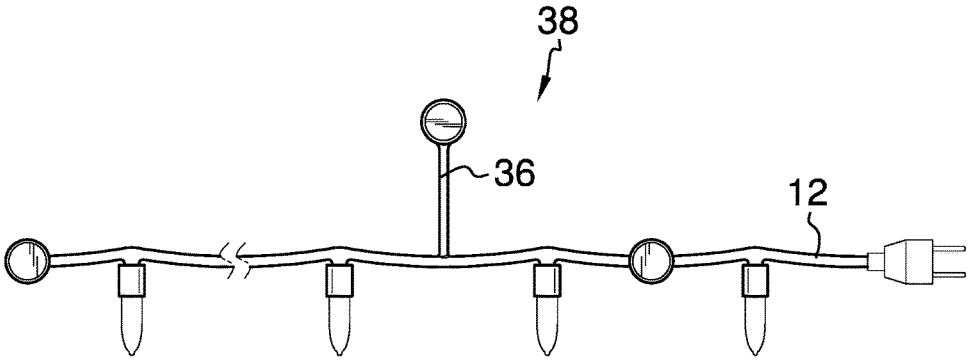
FIG. 6 is a perspective view of an alternative embodiment of the disclosure.

In an alternative embodiment 34 as shown in FIG. 5, each of the retainers 22 may include a cord 36 that extends between the peripheral edge 30 of the disk 26 and the conductor 12. In this way the disk 26 and the magnet 32 are spaced from the conductor 12. The cord 36 may extend over a gutter on the building thereby facilitating conductor 12 to be positioned below the gutter. The cord 36 may have a length of approximately 20.0 cm. In an alternative embodiment 38 as shown in FIG. 6, the cord 36 may be included on alternating ones of the retainers 22. Additionally, the cord 36 in the alternative embodiment 38 as shown in FIG. 6 may have a length of approximately 5.0 cm.

In use, the conductor 12 is positioned to extend along the perimeter of the roof on the building. The magnet 32 corresponding to each of the retainers 22 magnetically engages the metal roof on the building. In this way the conductor 12 and the lights are removably coupled to the building for ornamental purposes. Moreover, the retainers 22 facilitate Christmas lights to be displayed on a building with a steel roof without the use of penetrating fasteners.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A magnetic Christmas light assembly being configured to magnetically engage a support surface, said assembly comprising:

a conductor being configured to be electrically coupled to a power source;

a plurality of light emitters, each of said light emitters being electrically coupled to said conductor wherein each of said light emitters is configured to selectively emit light; and a plurality of retainers, each of said retainers being coupled to said conductor wherein each of said retainers is configured to magnetically engage a support surface thereby facilitating said conductor to be removably retained on the support surface, each of said retainers comprising a disk having a first surface and a peripheral edge, said conductor extending through said peripheral edge of each said disk such that each said disk is coupled to said conductor and each said disk is aligned with a length of said conductor between an adjacently positioned pair of said light emitters.

2. The assembly according to claim 1, wherein:

said conductor has a first end and a second end; and a plug being electrically coupled to said conductor wherein said plug is configured to be electrically coupled to the power source, said plug being positioned on said second end said conductor.

3. The assembly according to claim 1, further comprising a magnet being coupled to said first surface of said disk wherein said magnet is configured to magnetically engage the support surface.

4. A magnetic Christmas light assembly being configured to magnetically engage a support surface, said assembly comprising:

a conductor being configured to be electrically coupled to a power source, said conductor having a first end and a second end;

a plug being electrically coupled to said conductor wherein said plug is configured to be electrically coupled to the power source, said plug being positioned on said second end said conductor;

a plurality of light emitters, each of said light emitters being electrically coupled to said conductor wherein each of said light emitters is configured to selectively emit light, said light emitters being spaced apart from each other and being distributed along said conductor; and a plurality of retainers, each of said retainers being coupled to said conductor wherein each of said retainers is configured to magnetically engage a support surface thereby facilitating said conductor to be removably retained on the support surface, said retainers being spaced apart from each other and being distributed between said first end and said second end, each of said retainers comprising:

a disk having a first surface and a peripheral edge, said conductor extending through said peripheral edge of each said disk such that each said disk is coupled to said conductor and each said disk is aligned with a length of said conductor between an adjacently positioned pair of said light emitters, and a magnet being coupled to said first surface of said disk wherein said magnet is configured to magnetically engage the support surface.

* * * * *